US009184542B2

(12) United States Patent
Torii et al.

(10) Patent No.: US 9,184,542 B2
(45) Date of Patent: Nov. 10, 2015

(54) CONNECTOR COVER REGULATING RIB AND GROOVE

(75) Inventors: Chieko Torii, Makinohara (JP); Takuya Hasegawa, Fujieda (JP); Nozomi Tsurukubo, Fujieda (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/240,088

(22) PCT Filed: Aug. 8, 2012

(86) PCT No.: PCT/JP2012/005032

§ 371 (c)(1),
(2), (4) Date: Mar. 24, 2014

(87) PCT Pub. No.: WO2013/027352

PCT Pub. Date: Feb. 28, 2013

(65) Prior Publication Data

US 2014/0206242 A1 Jul. 24, 2014

(30) Foreign Application Priority Data

Aug. 24, 2011 (JP) ..... 2011-182296

(51) Int. Cl.
*H01R 13/58* (2006.01)
*H01R 13/639* (2006.01)

(52) U.S. Cl.
CPC ..... *H01R 13/639* (2013.01); *H01R 13/5829* (2013.01)

(58) Field of Classification Search
CPC ..... H01R 13/5812; H01R 13/501; H01R 13/506; H01R 13/5829; H01R 13/64
USPC ..... 439/470, 471, 596, 465, 466, 467, 680
See application file for complete search history.

(56) References Cited

U.S. PATENT DOCUMENTS 3,771,104 A * 11/1973 Clark ..... 439/415
5,876,224 A * 3/1999 Chadbourne ..... 439/110

(Continued)

FOREIGN PATENT DOCUMENTS

CN 1217593 A 5/1999
JP 11-144796 A 5/1999

(Continued)

OTHER PUBLICATIONS

International Search Report for PCT/JP2012/005032 dated Nov. 13, 2012.

(Continued)

*Primary Examiner* — Hae Moon Hyeon
(74) *Attorney, Agent, or Firm* — Sughrue Mion, PLLC

(57) ABSTRACT

A connector with a cover (1) includes a connector housing (11) and a cover (21) fitted in the connector housing. The connector housing has a regulating rib (16) provided projecting in a second direction perpendicular to a first direction where the fitted cover is pulled away from the connector housing. The cover has a regulating groove (26) that is formed into a shape corresponding to the regulating rib, and into which the regulating rib is inserted when the cover is fitted in the connector housing. The regulating rib is formed to become larger in width in the first direction from a base end toward a tip in the second direction. Release of the fitting of the cover in the connector housing is regulated by the regulating groove and the regulating rib inserted into the regulating groove in a state where the cover is fitted in the connector housing.

3 Claims, 9 Drawing Sheets

(56) References Cited

U.S. PATENT DOCUMENTS

| | | | | |
|---|---|---|---|---|
| 5,908,327 | A * | 6/1999 | Tsuji et al. | 439/470 |
| 5,967,830 | A * | 10/1999 | Tsuji | 439/470 |
| 6,019,638 | A | 2/2000 | Saka et al. | |
| 6,142,813 | A * | 11/2000 | Cummings et al. | 439/374 |
| 6,203,362 | B1 * | 3/2001 | Tsuji | 439/470 |
| 6,461,201 | B1 * | 10/2002 | Maeda et al. | 439/701 |
| 6,846,191 | B2 * | 1/2005 | Hobbs et al. | 439/157 |
| 8,435,068 | B2 * | 5/2013 | Oomori | 439/465 |
| 8,568,159 | B2 * | 10/2013 | Noda et al. | 439/470 |
| 2004/0072465 | A1 | 4/2004 | Murakami | |
| 2004/0147158 | A1 | 7/2004 | Hobbs et al. | |
| 2014/0017927 | A1 * | 1/2014 | Kida et al. | 439/350 |
| 2015/0037988 | A1 * | 2/2015 | Torii et al. | 439/136 |

FOREIGN PATENT DOCUMENTS

| | | | |
|---|---|---|---|
| JP | 2001-143812 | A | 5/2001 |
| JP | 2001-185318 | A | 7/2001 |
| JP | 2005-318706 | A | 11/2005 |
| JP | 2008-293810 | A | 12/2008 |
| JP | 2010-9788 | A | 1/2010 |

OTHER PUBLICATIONS

Communication dated Dec. 30, 2014, issued by the Korean Intellectual Property Office in corresponding Application No. 10-2014-7007594.

Communication dated Apr. 8, 2015 from the Canadian Intellectual Property Office in counterpart application No. 2,846,114.

Communication dated Jul. 8, 2015 from the Korean Intellectual Property Office in counterpart application No. 10-2014-7007594.

Communication dated Jul. 22, 2015 from the State Intellectual Property Office of the People's Republic of China in counterpart application No. 201280041264.0.

* cited by examiner

CONNECTOR COVER REGULATING RIB AND GROOVE

TECHNICAL FIELD

The present invention relates to a connector with a cover provided with the cover that covers and protects an electric wire pulled out from a connector housing.

BACKGROUND ART

Conventionally, as a connector with a cover provided with the cover that covers and protects an electric wire pulled out from a connector housing, for example, a connector with a cover described in Patent Literature 1 has been proposed.

This connector with the cover is substantially configured with a connector housing that houses a terminal connected to an end of an electric wire, and the cover that is fitted in the connector housing to cover the electric wire pulled out from the connector housing.

The connector housing has a fitting projecting portion provided projecting in a direction perpendicular to a direction where the cover fitted in the connector housing is pulled away from the connector housing. The fitting projecting portion is formed having a same width over an entire length in a projecting direction from the connector housing. Additionally, the fitting projecting portion extends in a straight line in a direction perpendicular to both the projecting direction from the connector housing and a pulling-away direction of the cover from the connector housing. Meanwhile, the cover has a fitting concave portion into which, when the cover is made to fit in the connector housing, the fitting projecting portion is inserted from one end side in an extending direction thereof.

Then, the fitting projecting portion is inserted into the fitting concave portion, and thereby the cover is fitted in the connector housing.

CITATION LIST

Patent Literature

[PTL 1]
Japanese Patent Application Laid-Open Publication No. 2010-9788

SUMMARY OF INVENTION

Technical Problem

Incidentally, in the above-described connector with the cover, a torsional force may be applied to a fitting portion of the connector housing and the cover. Additionally, depending on a torsional direction, a force in the projecting direction of the fitting projecting portion with respect to the connector housing (a direction where the fitting projecting portion is withdrawn from the fitting concave portion of the cover) may be applied between the connector housing and the cover by the torsional force.

However, since the fitting projecting portion is formed having the same width over the entire length in the projecting direction from the connector housing in the above-described connector with the cover, it tends to occur that fitting of the fitting projecting portion and the fitting concave portion is released, and the cover easily comes away from the connector housing when a force in a direction to withdraw the fitting projecting portion from the fitting concave portion is applied between the cover and the connector housing. Therefore, there has been a problem that a cover holding force to the torsional force was low.

An object of the present invention is to provide a connector with a cover in which a cover holding force to a torsional force is improved.

Solution to Problem

In order to achieve the above-described object, according to an aspect of the present invention, there is provided a connector with a cover comprising: a connector housing that houses a terminal connected to an electric wire; and a cover that is fitted in the connector housing and covers the electric wire pulled out from the connector housing, wherein one member of the connector housing and the cover has a regulating rib that is provided projecting from the one member in a second direction perpendicular to a first direction where the cover fitted in the connector housing is pulled away from the connector housing; the regulating rib is provided extending in a straight line in a third direction perpendicular to the first direction and the second direction; the other member of the connector housing and the cover has a regulating groove that is formed into a shape corresponding to the regulating rib, and that receives the regulating rib inserted from the third direction when the cover is fitted in the connector housing; the regulating rib is formed to become larger in width in the first direction from a base end toward a tip in the second direction; and release of the fitting of the cover in the connector housing is regulated by the regulating groove and the regulating rib inserted into the regulating groove in a state where the cover is fitted in the connector housing.

According to an aspect of the present invention, the one member has a guide rib that is provided extending in parallel with the regulating rib in the third direction of the regulating rib, and that is provided projecting from the one member in the second direction, the other member has a guide groove that receives the guide rib inserted from the third direction when the cover is fitted in the connector housing, and a cross-sectional shape of the regulating rib cut by a flat surface perpendicular to the third direction is different from a cross-sectional shape of the guide rib cut by the flat surface perpendicular to the third direction.

According to an aspect of the present invention, the guide groove has a pressing rib that is provided projecting from an inner wall surface of the guide groove, and that, in contact with one side surface of the guide rib in a width direction of the guide rib, presses the other side surface of the guide rib in the width direction of the guide rib against an inner wall surface of the guide groove.

According to the aspect of the present invention, the regulating rib of one member of the connector housing and the cover is formed so as to be provided projecting from the one member in the second direction perpendicular to the first direction where the cover is pulled away from the connector housing, and to become larger in width in the first direction from the base end toward the tip in the second direction. In addition, the regulating groove of the other member of the connector housing and the cover is formed into the shape corresponding to the regulating rib. Therefore, when a torsional force including a tensile force in the direction pulled away from the connector housing is applied to the cover, the regulating rib does not come away from the regulating groove.

Accordingly, a connector with a cover can be provided in which a cover holding force to a torsional force is improved.

According to the aspect of the present invention, the other member of the connector housing and the cover has the guide groove into which the guide rib having a cross-sectional shape different from that of the regulating rib is inserted. Therefore, when the regulating rib is inserted into the guide groove, it can be detected from a difference of the mutual cross-sectional shapes that the cover has been fitted in a wrong position, thus enabling to prevent the cover from being fitted in the wrong position.

According to the connector with the cover in accordance with the aspect of the present invention, the guide groove has the pressing rib that, in contact with the one side surface of the guide rib in the width direction of the guide rib, presses the other side surface of the guide rib in the width direction of the guide rib against the inner wall surface of the guide groove. Therefore, vibration and an unusual sound due to backlash of the guide rib in the guide groove in the width direction can be suppressed.

Advantageous Effects of Invention

According to the present invention, a connector with a cover can be provided in which a cover holding force to a torsional force is improved.

DESCRIPTION OF EMBODIMENTS

Hereinafter, a connector with a cover in accordance with an embodiment of the present invention will be described with reference to drawings. First, with reference to FIGS. 1, 2A, and 2B, will be described in detail a connector housing that constitutes the connector with the cover in accordance with the embodiment of the present invention.

Figure 1:
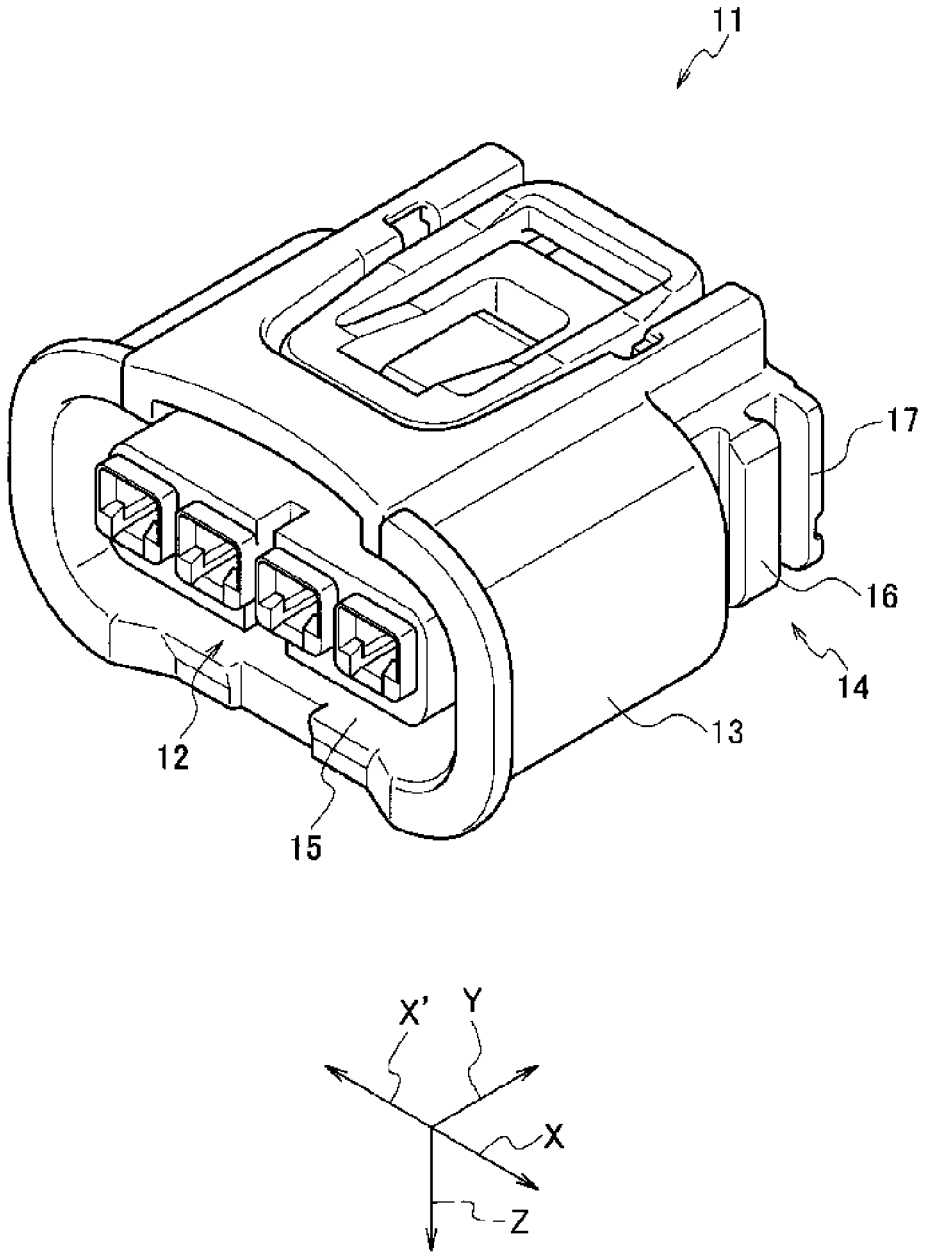
FIG. 1 is a perspective view showing a connector housing that constitutes a connector with a cover in accordance with an embodiment of the present invention.
Figure 2A:
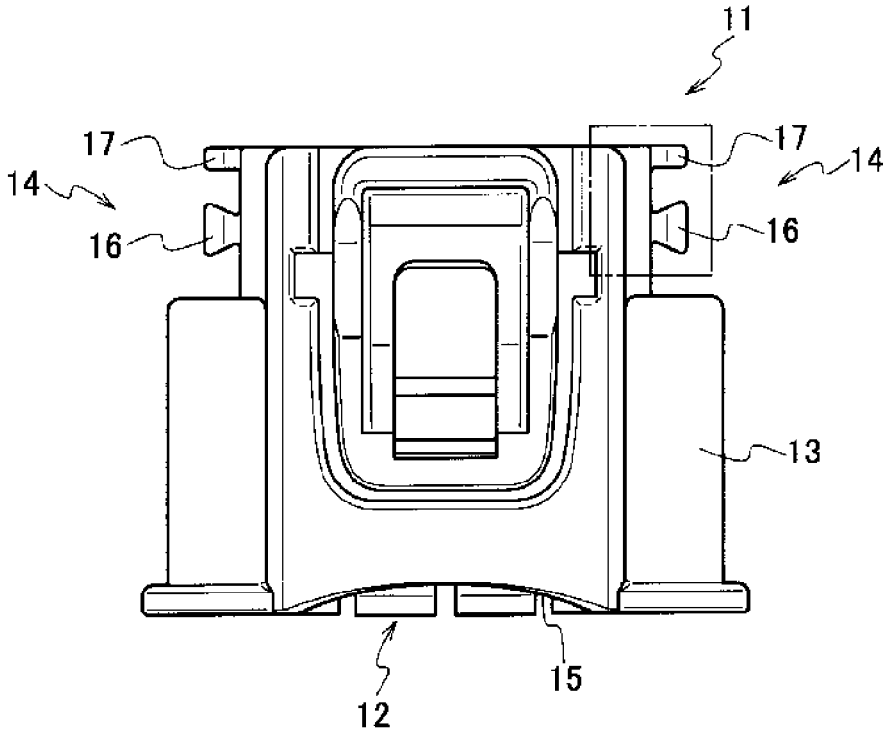
FIG. 2A is a plan view showing a regulating rib and a guide rib of the connector housing of FIG. 1.
Figure 2B:
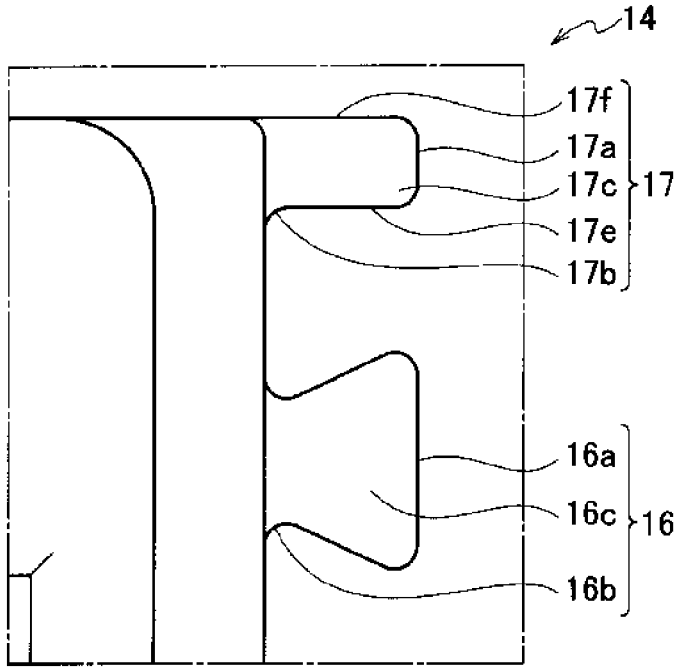
FIG. 2B is an enlarged plan view showing a coupling portion of the connector housing of FIG. 2A.

FIG. 1 is a perspective view showing the connector housing that constitutes the connector with the cover in accordance with the embodiment of the present invention. FIG. 2A is a plan view of the connector housing of FIG. 1. FIG. 2B is an enlarged plan view showing a coupling portion of the connector housing of FIG. 2A.

It is to be noted that the connector with the cover in accordance with the embodiment of the present invention relates to a connector with a cover 1 provided with: a connector housing 11 that houses a terminal (not shown) connected to an electric wire; and a cover 21 (that will be described later with reference to FIG. 3) that is fitted in the connector housing 11 to cover an electric wire (not shown) pulled out from the connector housing 11 (refer to FIGS. 6, 8, and 9A that will be described later).

As shown in FIGS. 1, 2A, and 2B, the connector housing 11 in accordance with the embodiment of the present invention has a connector housing body 13 having a terminal housing chamber 12 in which a plurality of terminals is housed, and a coupling portion 14 that is consecutively provided in the connector housing body 13 and arranged at the outside thereof.

The connector housing body 13 has an insertion opening 15 through which inserted is the other side connector housing (not shown) in which terminals to be connected to the plurality of terminals (not shown) housed in the terminal housing chamber 12 have been housed.

The coupling portion 14 is, as shown in FIG. 2A, provided on sides (both upper right and left sides in FIG. 2A) in which the cover 21 of the connector housing body 13 is fitted, in order to fit the cover 21 of FIG. 3 that will be described later in the connector housing 11. Each coupling portion 14 has a regulating rib 16 and a guide rib 17.

The regulating rib 16 is provided projecting from the connector housing body 13 in a direction (arrow X and arrow X' directions of FIG. 1: the second direction) perpendicular to a direction (an arrow Y direction of FIG. 1: the first direction) where the cover 21 (refer to FIG. 3 that will be described later) fitted in the connector housing 11 is pulled away from the connector housing 11. Additionally, the regulating rib 16 extends in a straight line in a direction (an arrow Z direction of FIG. 1: the third direction) perpendicular to both a projecting direction (the arrow X and arrow X' directions of FIG. 1) and a pulling-away direction (the arrow Y direction of FIG. 1) of the cover 21 from the connector housing 11. In addition, the regulating rib 16 is, as shown in FIG. 2B, formed to become larger in width from a base end 16*a* toward a tip 16*b* in the projecting direction (the arrow X and arrow X' directions of FIG. 1).

The regulating rib 16 regulates release of fitting of the cover 21 in the connector housing 11 in cooperation with a regulating groove 26 by being inserted from an end 16*c* into the regulating groove 26 of the cover 21 that will be described later with reference to FIGS. 3 and 4.

In addition, the guide rib 17 is, as shown in FIGS. 1 and 2A, provided projecting from the connector housing body 13 in a same direction (the arrow X and arrow X' directions of FIG. 1) as the regulating rib 16. Additionally, the guide rib 17 extends in a straight line in parallel with the regulating rib 16 in the direction (the arrow Z direction of FIG. 1) perpendicular to both the projecting direction (the arrow X and arrow X' directions of FIG. 1) and the pulling-away direction (the arrow Y direction of FIG. 1) of the cover 21 from the connector housing 11. In addition, the guide rib 17 is, as shown in FIG. 2B, formed having a same width from a base end 17*b* to a tip 17*a* of the projecting direction (the arrow X and arrow X' directions of FIG. 1) of the guide rib 17.

Figure 3:
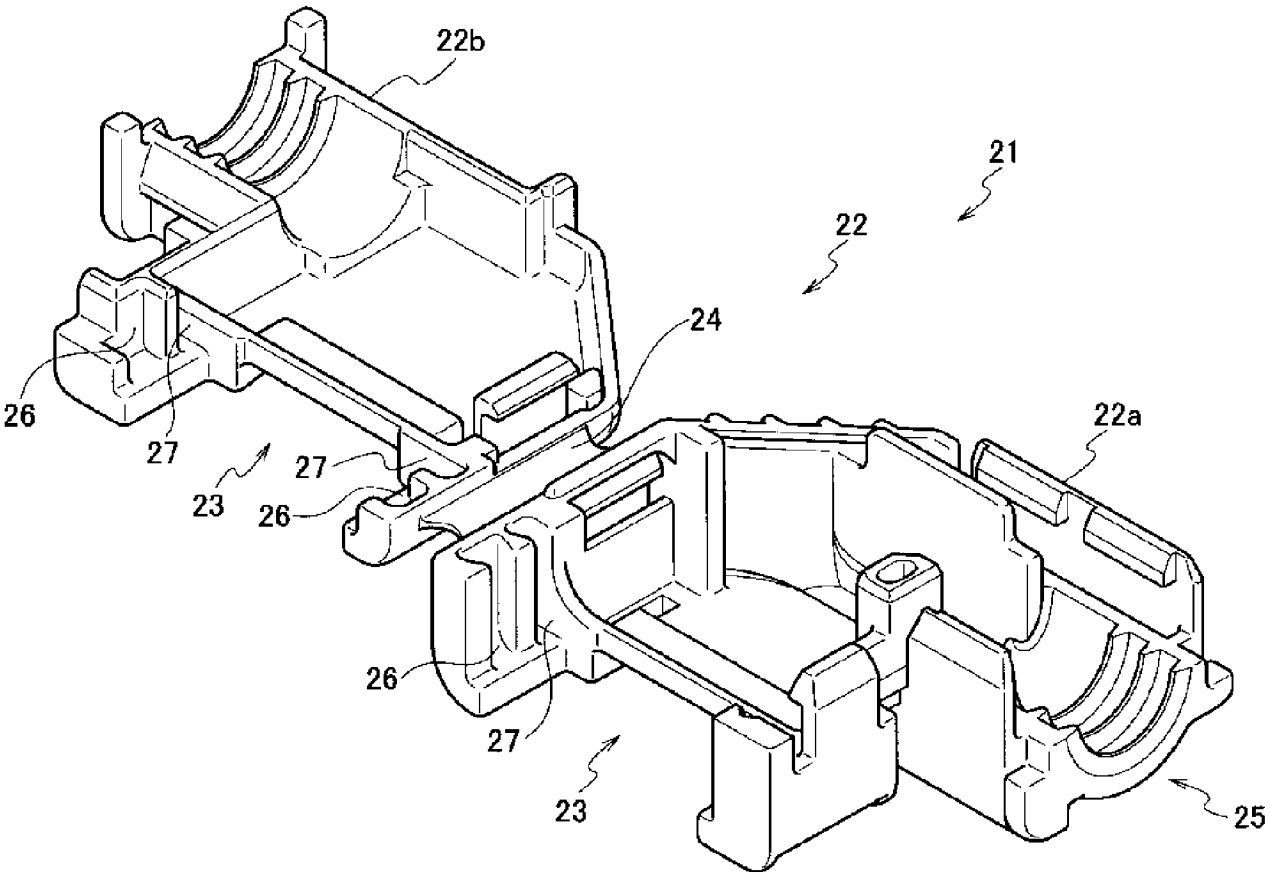
FIG. 3 is a perspective view in a developed state showing the cover that constitutes the connector with the cover in accordance with the embodiment of the present invention.
Figure 4:
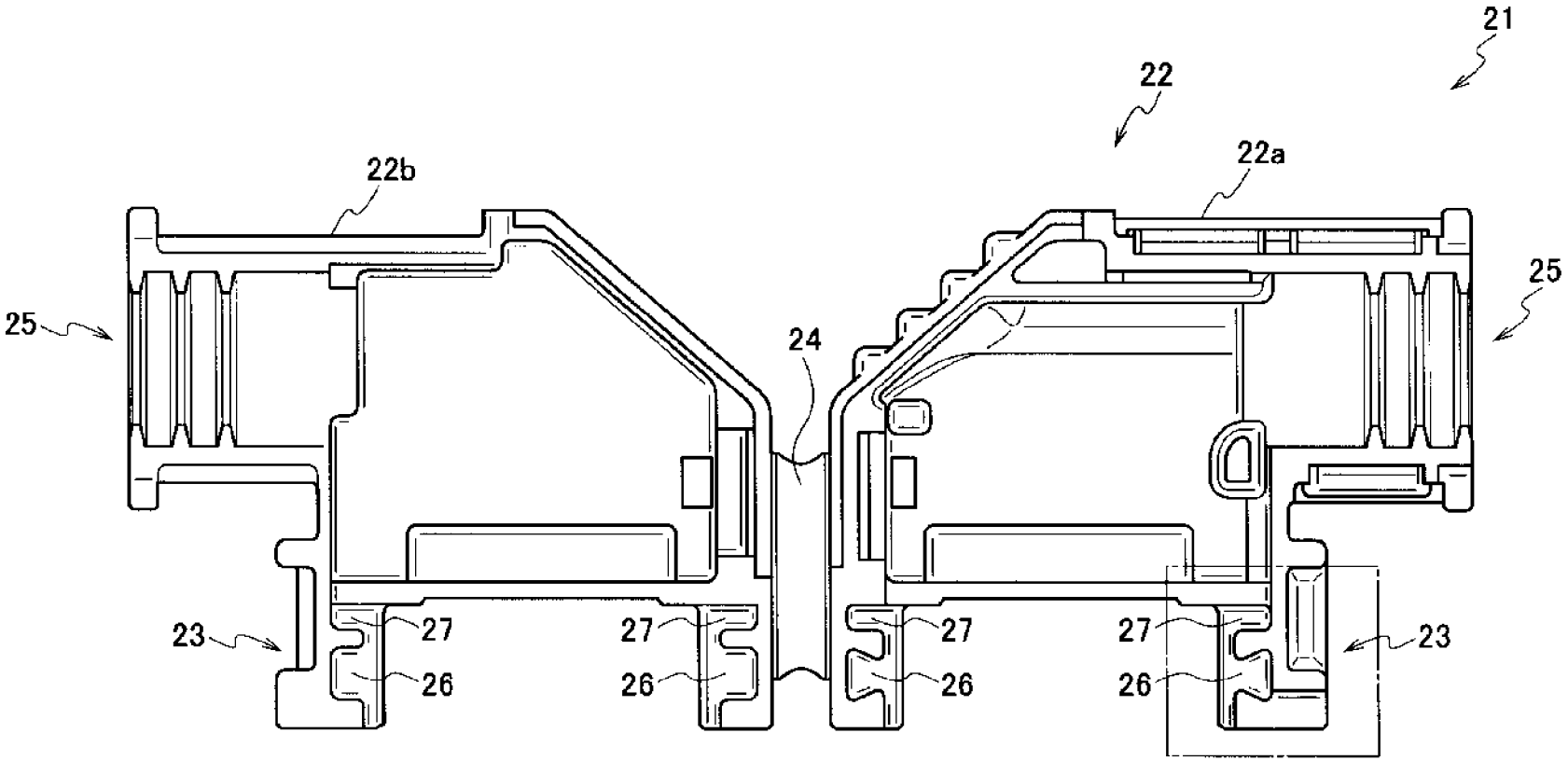
FIG. 4 is a plan view in a developed state showing the cover that constitutes the connector with the cover in accordance with the embodiment of the present invention.

This guide rib 17 is inserted into a guide groove 27 of the cover 21 shown in FIGS. 3 and 4 from an end 17*c* (refer to FIG. 2B) in the regulating rib 16 being inserted in the regulating groove 26 of the cover 21 shown in FIGS. 3 and 4 from the end 16*c*.

In addition, the guide rib 17 has a side surface 17*e* that gets contact with a pressing rib 29 (refer to FIG. 5 that will be described later) provided projecting from an inner wall surface 28*a* (refer to FIG. 5 that will be described later) of the guide groove 27 that will be described later with reference to FIGS. 3 to 5, and a side surface 17*f* pressed against an opposing inner wall surface 28*b* (refer to FIG. 5 that will be described later) of the guide groove 27 when the side surface 17*e* gets contact with the pressing rib 29.

The above-described regulating rib 16 and guide rib 17 are formed so that shapes of cross sections perpendicular to the respective extending directions (the arrow Z direction of FIG. 1) mutually differ. Namely, although the cross-sectional shape of the regulating rib 16 is a substantially trapezoidal shape, the cross-sectional shape of the guide rib 17 is a substantially rectangular shape (refer to FIG. 2B).

Next, with reference to FIGS. 3 to 5, will be described in detail the cover that constitutes the connector with the cover in accordance with the embodiment of the present invention. FIG. 3 is a perspective view in a developed state showing the cover in accordance with the embodiment of the present invention.

In addition, FIG. 4 is a plan view in the developed state showing the cover of FIG. 3. FIG. 5 is an enlarged plan view showing a coupled portion of the cover of FIG. 4.

As shown in FIGS. 3 and 4, the cover 21 has a cover body 22, and a coupled portion 23 that is provided inside of the cover body 22, and coupled to the coupling portion 14 (refer to FIGS. 1, 2A, and 2B) at the time of fitting the cover 21 in the connector housing 11 (refer to FIGS. 1, 2A, and 2B).

The cover body 22 has a first cover body 22*a* and a second cover body 22*b*, the first cover body 22*a* and the second cover body 22*b* are connected through a hinge 24, and the cover body 22 is configured so that the first cover body 22*a* and the second cover body 22*b* in a state of being opened can be folded.

In the cover body 22 (the first cover body 22*a* and the second cover body 22*b*), formed is an elongated domy (box-shaped) derivation opening 25 that derives an electric wire (not shown) to the outside of the cover body 22 at the time of fitting the cover 21 in the connector housing 11.

The coupled portion 23 has the regulating groove 26 that is formed as a shape corresponding to the regulating rib (refer to FIGS. 1, 2A, and 2B), and into which the regulating rib 16 is inserted from the end 16*c* (refer to FIG. 2B) of the extending direction (the arrow Z direction of FIG. 1) at the time of fitting the cover 21 in the connector housing 11 (refer to FIGS. 1, 2A, and 2B).

The regulating rib 16 is inserted into the regulating groove 26 from the end 16*c* (refer to FIG. 2B) in a state (for example, a state shown in FIG. 8) where the cover 21 is fitted in the connector housing 11 (refer to FIGS. 1, 2A, and 2B), and thereby release of fitting of the cover 21 in the connector housing 11 is regulated.

In addition, the coupled portion 23 has the guide groove 27 into which the guide rib 17 (refer to FIGS. 1, 2A, and 2B) is inserted from the end 17*c* (refer to FIG. 2B) of the extending direction thereof at the time of fitting the cover 21 in the connector housing 11 (refer to FIGS. 1, 2A, and 2B).

The guide rib 17 is inserted into the guide groove 27 from the end 17*c* (refer to FIG. 2B) in the state (for example, the state shown in FIG. 8 that will be described later) where the cover 21 is fitted in the connector housing 11 (refer to FIGS. 1, 2A, and 2B).

Figure 5:
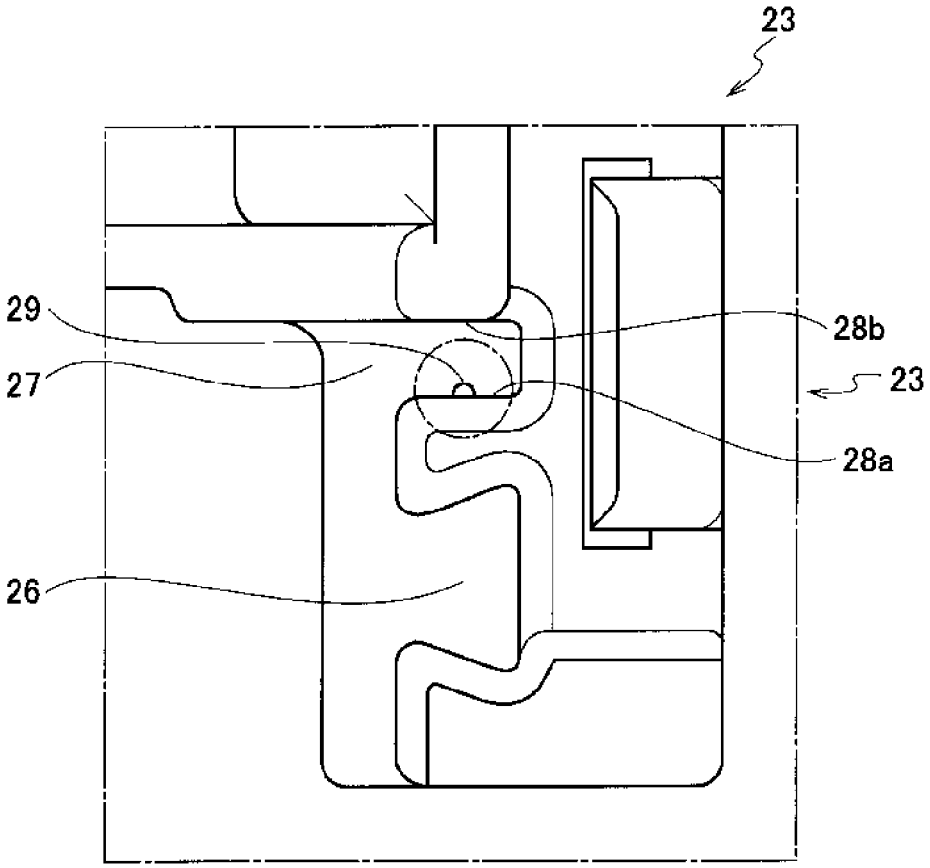
FIG. 5 is an enlarged plan view showing a coupled portion of the cover of FIGS. 3 and 4.

In addition, the guide groove 27, as shown in FIG. 5, has the pressing rib 29 that is provided projecting from the inner wall surface 28*a* of the guide groove 27, and that, in contact with the guide rib 17 (refer to FIGS. 1, 2A, and 2B) from one side (the side surface 17*e* of FIG. 2B) in a width direction (the arrow Y direction of FIG. 1), presses the other side (the side surface 17*f* of FIG. 2B) in the width direction (the arrow Y direction of FIG. 1) of the guide rib 17 against the opposing inner wall surface 28*b* of the guide groove 27.

As described above, the guide groove 27 has the pressing rib 29 that, in contact with the guide rib 17 from one side in the width direction thereof (the arrow Y direction of FIG. 1), presses the other side (the side surface 17*f* of FIG. 2B) of the guide groove 27 against the opposing inner wall surface 28*b* of the guide groove 27. Therefore, vibration and an unusual sound due to backlash of the guide rib 17 in the guide groove 27 in the width direction (the arrow Y direction of FIG. 1) can be suppressed.

Next, with reference to FIGS. 6 to 9B, will be described an operational advantage of fitting work and the connector with the cover in fitting the cover in the connector housing that constitutes the connector with the cover in accordance with the embodiment of the present invention.

Figure 6:
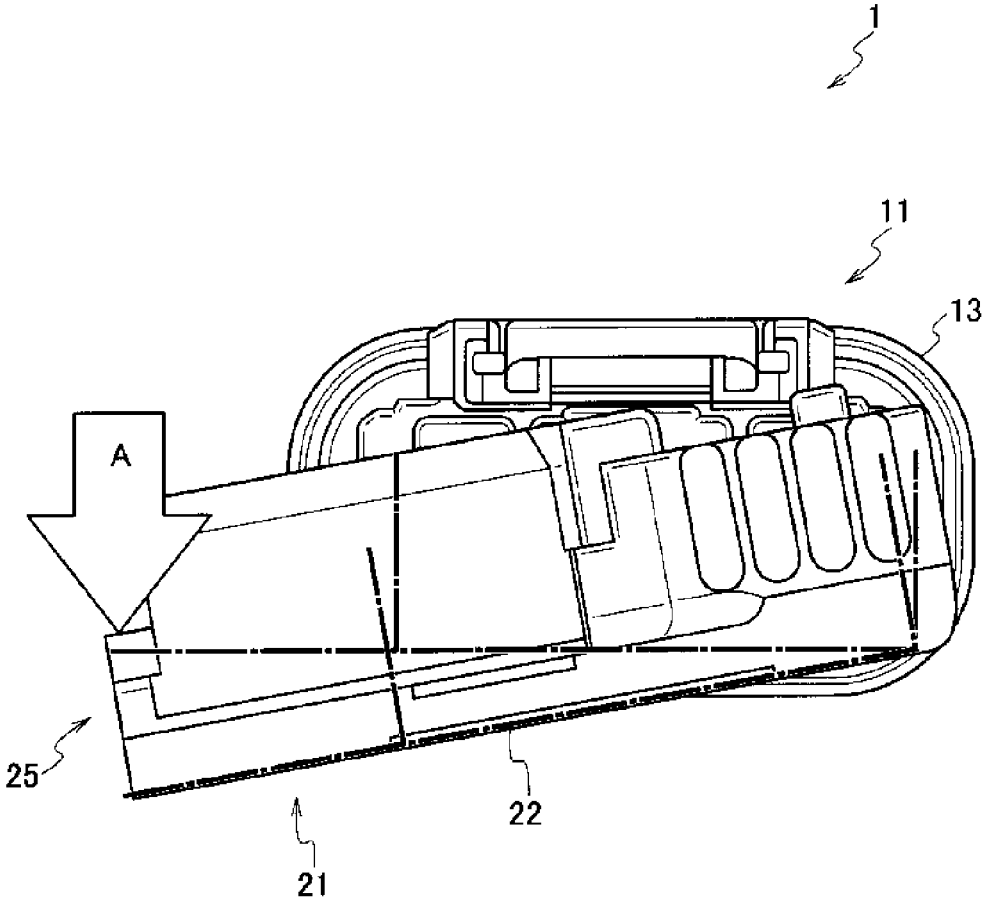
FIG. 6 is an explanatory view showing a case where a torsional force is applied to a fitting portion of the connector housing and the cover that constitute the connector with the cover in accordance with the embodiment of the present invention.
Figure 7A:
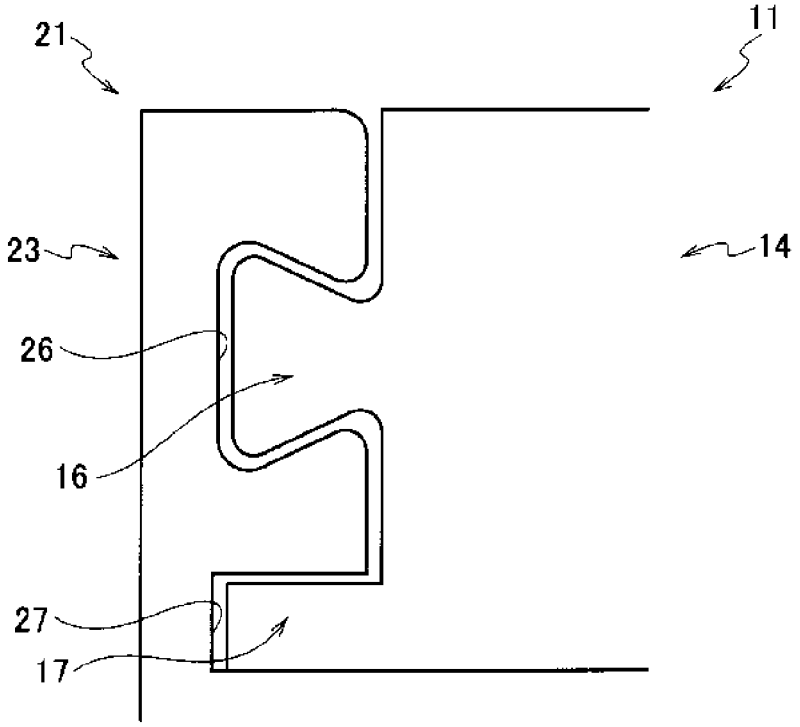
FIG. 7A is an enlarged plan view showing a part of the coupling portion and the coupled portion that constitute the connector with the cover in accordance with the embodiment of the present invention.
Figure 7B:
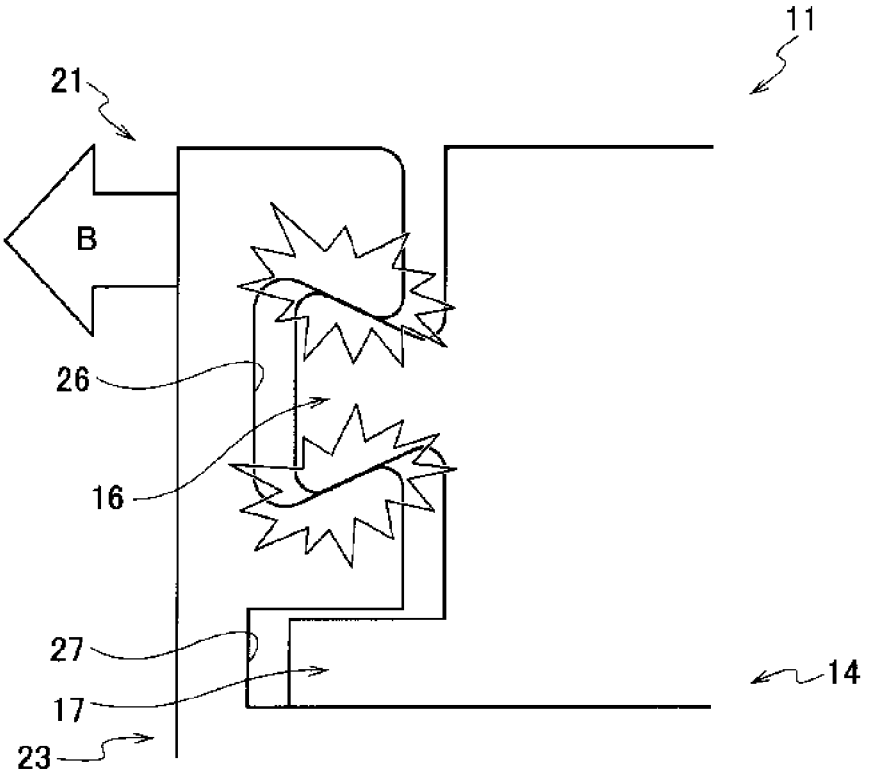
FIG. 7B is a plan view showing a case where a tensile force in a pulling-away direction from the connector housing is applied to the cover that constitutes the connector with the cover in accordance with the embodiment of the present invention.

FIG. 6 is an explanatory view showing a case where a torsional force is applied to a fitting portion of the connector housing and the cover that constitute the connector with the cover in accordance with the embodiment of the present invention. FIG. 7A is an enlarged plan view showing a part of the coupling portion and the coupled portion that constitute the connector with the cover in accordance with the embodiment of the present invention. FIG. 7B is a plan view showing a case where a tensile force in a pulling-away direction from the connector housing is applied to the cover that constitutes the connector with the cover in accordance with the embodiment of the present invention.

Figure 8:
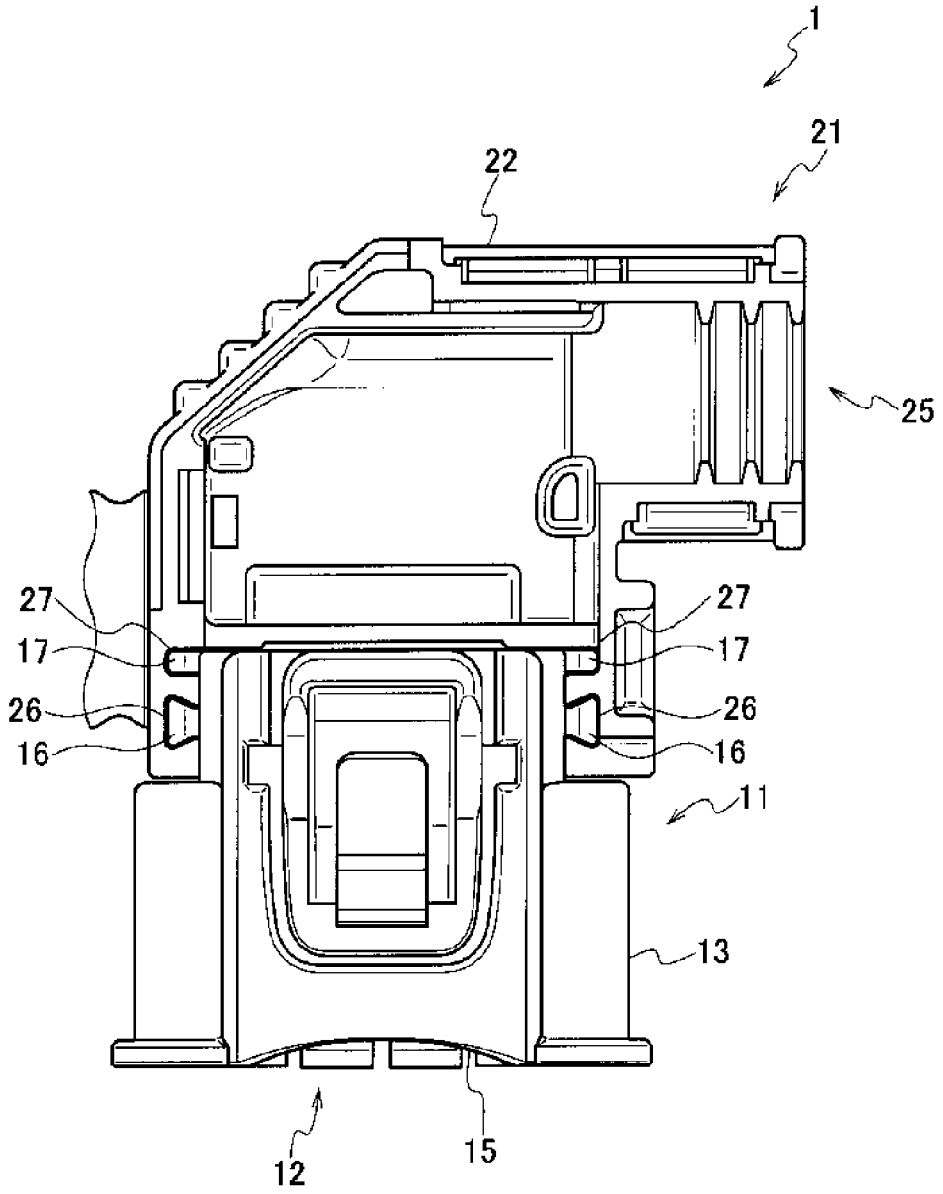
FIG. 8 is a plan view showing the connector with the cover in accordance with the embodiment of the present invention.
Figure 9A:
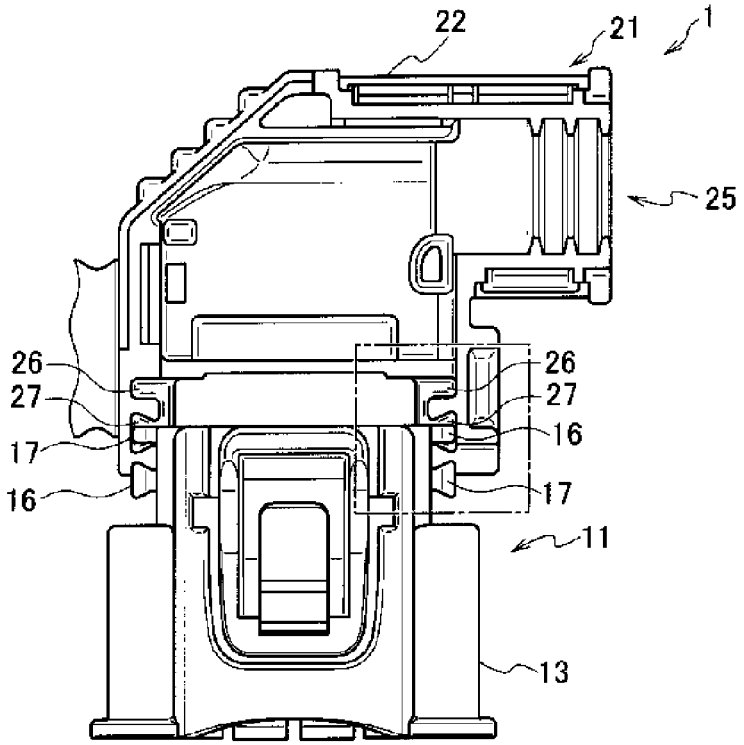
FIG. 9A is a plan view showing a case where the cover is intended to be fitted in a wrong position of the connector housing that constitutes the connector with the cover in accordance with the embodiment of the present invention.
Figure 9B:
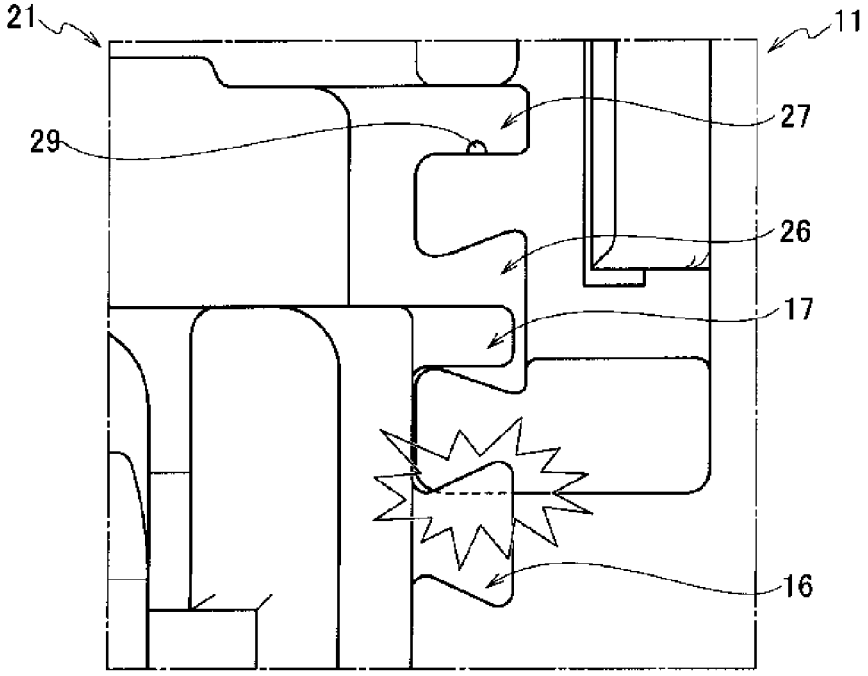
FIG. 9B is an enlarged plan view showing a part of the coupling portion of the connector housing and the coupled portion of the cover of FIG. 9A.

In addition, FIG. 8 is a plan view showing the connector with the cover in accordance with the embodiment of the present invention. FIG. 9A is a plan view showing a case where the cover is intended to be fitted in a wrong position of the connector housing that constitutes the connector with the cover in accordance with the embodiment of the present invention. FIG. 9B is an enlarged plan view showing a part of the coupling portion of the connector housing and the coupled portion of the cover of FIG. 9A.

As shown in FIGS. 6 to 9B, the cover 21 is fitted in the connector housing 11 into which an other side connector housing (not shown) has been inserted from the insertion opening 15 (refer to FIG. 1) of the connector housing 11.

Then, an electric wire (not shown) of a terminal housed in the terminal housing chamber 12 (refer to FIG. 1) of the connector housing 11 connected to a terminal (not shown) housed in the other side connector housing is pulled out from the connector housing 11, and the electric wire is derived from the derivation opening 25 (FIGS. 3 and 4) of the cover 21 to cover the electric wire.

In fitting the cover 21 in the connector housing 11, as shown in FIG. 7A, the regulating rib 16 of the coupling portion 14 of the connector housing 11 is inserted from the end 16*c* (refer to FIG. 2B) into the regulating groove 26 of the coupled portion 23 of the first cover body 22*a* or the second cover body 22*b* of the cover 21 in a state (a state shown in FIGS. 3 and 4) of being opened. Subsequently, in covering the connector housing 11 with the second cover body 22*b* or the first cover body 22*a* and overlapping them with each other, a remaining portion of the regulating rib 16 is inserted into the regulating groove 26 of the coupled portion 23.

As a result, the cover 21 is fitted in the connector housing 11. In this state, release of fitting of the cover 21 in the connector housing 11 is regulated by engagement of the regulating groove 26 and the regulating rib 16 inserted thereinto.

As described above, the regulating rib 16 of the connector housing 11 is formed so as to be provided projecting in the direction perpendicular to the direction (the arrow Y direction of FIG. 1) where the cover 21 is pulled away from the connector housing 11, and to become larger in width from the base end 16*b* toward the tip 16*a* in the projecting direction (the arrow X and arrow X' directions of FIG. 1). In addition, the regulating groove 26 is formed in the cover 21 into a shape corresponding to the regulating rib 16.

Here, as shown with an arrow A in FIG. 6, a case is assumed where a torsional force to the connector housing 11 is applied to the cover 21. In this case, in the regulating rib 16 of the connector housing 11 arranged on the observers' right in FIG. 6, a tensile force in a direction (refer to an arrow B of FIG. 7B) where the cover 21 is pulled away from the connector housing 11 is, as shown in FIG. 7B, applied in one end side (a top end side in FIG. 6) in the extending direction (the arrow Z direction of FIG. 1, and a vertical direction of FIG. 6) of the regulating rib 16.

At this time, since the regulating rib 16 of the connector housing 11 has a wedge-shaped cross section in which a base end 16*b* side is thin and a tip 16*a* side is thick, and the regulating groove 26 of the cover 21 has a cross-sectional shape corresponding to the wedge-shaped cross section, the regulating rib 16 does not come away from the regulating groove 26.

It is to be noted that at the same time when the regulating rib 16 of the coupling portion 14 is inserted into the regulating groove 26 as shown in FIG. 7A, the guide rib 17 of the coupling portion 14 is inserted from the end 17*c* (refer to FIG. 2B) into the guide groove 27 of the coupled portion 23 of the first cover body 22*a* or the second cover body 22*b* in the developed state (the state shown in FIGS. 3 and 4). Subsequently, in covering the connector housing 11 with the second cover body 22*b* or the first cover body 22*a* and overlapping them with each other, a remaining portion of the guide rib 17 is inserted into the guide groove 27 of the coupled portion 23.

Here, the guide rib 17 and the guide groove 27, as described above, have cross-sectional shapes that are different from cross-sectional shapes of the regulating rib 16 and the regulating groove 26. Namely, as shown in FIGS. 9A and 9B, although the cross-sectional shape of the regulating rib is a substantially trapezoidal shape, the cross-sectional shape of the guide rib 17 is a substantially rectangular shape.

Therefore, even if the regulating rib 16 is erroneously intended to be inserted into the guide groove 27, it cannot be inserted due to a difference in mutual cross-sectional shapes of the regulating rib 16 and the guide groove 27. Therefore, the cover 21 can be prevented from being fitted in the wrong position (refer to FIG. 9B).

In addition, when the guide rib 17 is inserted into the guide groove 27, as described above, the pressing rib 29 of the guide groove 27 gets contact with the guide rib 17 from one surface side in the width direction (the arrow Y direction of FIG. 1), and presses the other surface (the side surface 17*f* of FIG. 2B) against the opposing inner wall surface 28*b* (refer to FIG. 5) of the guide groove 27.

Then, the first cover body 22*a* and the second cover body 22*b* in the state of being opened (the state shown in FIGS. 3 and 4) are folded in a state (a state shown in FIG. 8) where the regulating rib 16 has been inserted into the regulating groove 26, and the guide rib 17 has been inserted into the guide groove 27, and thereby the electric wire (not shown) pulled out from the connector housing 11 is covered.

The connector with the cover 1 in accordance with the embodiment of the present invention is provided with: the connector housing 11 that houses a terminal connected to an electric wire; and the cover 21 that is fitted in the connector housing 11 and covers the electric wire pulled out from the connector housing 11. The connector housing 11 has the regulating rib 16 provided projecting from the connector housing 11 in the second direction perpendicular to the first direction where the cover 21 fitted in the connector housing 11 is pulled away from the connector housing 11. The regulating rib 16 is provided extending in a straight line in the third direction perpendicular to the first direction and the second direction. The cover 21 has the regulating groove 26 that is formed as a shape corresponding to the regulating rib 16, and receives the regulating rib 16 inserted from the third direction at the time of fitting the cover 21 in the connector housing 11. The regulating rib 16 is formed to become larger in width from the base end 16*a* toward the tip 16*b* in the second direction. Release of the fitting of the cover in the connector housing 11 is regulated by the regulating groove 26 and the regulating rib 16 inserted into the regulating groove 26 in a state where the cover 21 is fitted in the connector housing 11.

In addition, in the connector with the cover 1 in accordance with the embodiment of the present invention, the connector housing 11 has the guide rib 17 that is provided extending in parallel with the regulating rib in the third direction of the regulating rib 16, and that is provided projecting from the connector housing 11 in the second direction. The cover 21 has the guide groove 27 that receives the guide rib 17 inserted from the third direction at the time of fitting the cover 21 in the connector housing 11. The cross-sectional shape of the regulating rib 16 cut by the flat surface perpendicular to the third direction is different from that of the guide rib 17 cut by the flat surface perpendicular to the third direction.

Further, in the connector with the cover 1 in accordance with the embodiment of the present invention, the guide groove 27 has the pressing rib 29 that is provided projecting from the inner wall surface 28 of the guide groove 27, and that, in contact with the one side surface of the guide rib 17 in the width direction of the guide rib 17, presses the other side surface of the guide rib 17 in the width direction of the guide rib 17 against the inner wall surface 28 of the guide groove 27.

According to the embodiment of the present invention, the regulating rib 16 of the connector housing 11 is formed so as to be provided projecting from the connector housing 11 in the second direction perpendicular to the first direction where the cover 21 is pulled away from the connector housing 11, and to become larger in width from the base end 16*a* toward the tip 16*b* in the second direction.

In addition, the regulating groove 26 of the cover 21 is formed as the shape corresponding to the regulating rib 16. Therefore, when a torsional force including a tensile force in the direction pulled away from the connector housing 11 is applied to the cover 21, the regulating rib 26 does not come away from the regulating groove 16.

Accordingly, the connector with the cover 1 can be provided in which a cover holding force to a torsional force is improved.

In addition, according to the embodiment of the present invention, the cover 21 has the guide groove 27 into which the guide rib 17 having the cross-sectional shape different from that of the regulating rib 16 is inserted. Therefore, when the regulating rib 16 is inserted into the guide groove 27, it cannot be inserted due to a difference in the mutual cross-sectional shapes of the regulating rib 16 and the guide groove 27. Therefore, the cover 21 can be prevented from being fitted in a wrong position.

Further, according to the embodiment of the present invention, the guide groove 27 has the pressing rib 29 that, in contact with the one side surface of the guide rib 17 in the width direction of the guide rib 17, presses the other side surface of the guide rib 17 in the width direction of the guide rib 17 against the inner wall surface 28*b* of the guide groove 27. Therefore, vibration and an unusual sound due to backlash of the guide rib 17 in the guide groove 27 in the width direction can be suppressed.

The connector with the cover of the present invention has been described above based on the illustrated embodiment, but the present invention is not limited to this, and a configuration of each component can be replaced with a component of an arbitrary configuration having a similar function.

For example, although the case has been described where the regulating rib 16 is provided in the connector housing 11, and the regulating groove 26 is provided in the cover 21 in the embodiment of the present invention, the regulating rib 16 may be provided in the cover 21, and the regulating groove 26 may be provided in the connector housing 11.

In addition, for example, although the case has been described where the guide rib 17 is provided in the connector housing 11, and the guide groove 27 is provided in the cover 21 in the embodiment of the present invention, the guide rib 17 may be provided in the cover 21, and the guide groove 27 may be provided in the connector housing 11.

INDUSTRIAL APPLICABILITY

The present invention is extremely useful to a connector with a cover that fits the cover to cover an electric wire pulled out from a connector housing in the connector housing that houses a terminal connected to the electric wire.

REFERENCE SIGNS LIST

1 connector with a cover
11 connector housing
12 terminal housing chamber
13 connector housing body
14 coupling portion
15 insertion opening
16 regulating rib
17 guide rib
21 cover
22 cover body
23 coupled portion
24 hinge
25 derivation opening
26 regulating groove
27 guide groove
28*a* and 28*b* inner wall surface
29 pressing rib

The invention claimed is:

1. A connector with a cover comprising:

a connector housing that houses a terminal connected to an electric wire; and the cover that is fitted in the connector housing and covers the electric wire pulled out from the connector housing, wherein one member of the connector housing and the cover has a regulating rib projecting from the one member in a second direction perpendicular to a first direction where the cover fitted in the connector housing is pulled away from the connector housing, the regulating rib extending in a straight line in a third direction perpendicular to the first direction and the second direction, the other member of the connector housing and the cover has a regulating groove that is formed into a shape corresponding to the regulating rib, and that receives the regulating rib inserted from the third direction when the cover is fitted in the connector housing, the regulating rib is formed to become larger in width in the first direction from a base end toward a tip in the second direction, and release of the fitting of the cover in the connector housing is regulated by the regulating groove and the regulating rib inserted into the regulating groove in a state where the cover is fitted in the connector housing.

2. The connector with a cover according to claim 1, wherein the one member has a guide rib that is provided extending in parallel with the regulating rib in the third direction of the regulating rib, and that is provided projecting from the one member in the second direction, the other member has a guide groove that receives the guide rib inserted from the third direction when the cover is fitted in the connector housing, and a cross-sectional shape of the regulating rib cut by a flat surface perpendicular to the third direction is different from a cross-sectional shape of the guide rib cut by the flat surface perpendicular to the third direction.

3. The connector with a cover according to claim 2, wherein the guide groove has a pressing rib that is provided projecting from an inner wall surface of the guide groove, and that, in contact with one side surface of the guide rib in a width direction of the guide rib, presses the other side surface of the guide rib in the width direction of the guide rib against an inner wall surface of the guide groove.

* * * * *